United States Patent [19]

Huber et al.

[11] Patent Number: 4,572,437

[45] Date of Patent: Feb. 25, 1986

[54] ELECTROSTATIC SPRAYING APPARATUS

[75] Inventors: Willi Huber, Heerbrugg; Markus Schmidhauser, Diepoldsau, both of Switzerland

[73] Assignee: J. Wagner AG, Switzerland

[21] Appl. No.: 484,281

[22] Filed: Apr. 12, 1983

[30] Foreign Application Priority Data

Apr. 19, 1982 [DE] Fed. Rep. of Germany ..... 3214314

[51] Int. Cl.[4] ..... B05B 5/04

[52] U.S. Cl. ..... 239/703; 239/700; 239/214.11; 239/223; 239/292; 239/296

[58] Field of Search ..... 239/700, 703, 704, 706, 239/697, 3, 690, 290, 292, 296, 297, 300, 301, 214.11, 214.17, 223, 420

[56] References Cited

U.S. PATENT DOCUMENTS

| | | | |
|---|---|---|---|
| 1,236,073 | 8/1917 | Fesler | 239/223 |
| 2,373,595 | 4/1945 | Peeps | 239/290 |
| 2,923,272 | 2/1960 | Emmert | 239/690 |
| 3,848,807 | 11/1974 | Partida | 239/296 |
| 4,132,357 | 1/1979 | Blackinton | 239/290 |

*Primary Examiner*—Andres Kashnikow
*Assistant Examiner*—James R. Moon, Jr.
*Attorney, Agent, or Firm*—Hill, Van Santen, Steadman & Simpson

[57] ABSTRACT

An electrostatic spraying apparatus for applying a liquid coating material to a work piece, and which comprises a rotating bell-like or disc-like atomizer head and an annular gap coaxial therewith which is connected to a compressed air source is provided with an improvement of a further annular gap connected to a compressed air source, the additional gap coaxially surrounding the first annular gap, and the gap width of at least one of the two annular gaps being adjustable.

9 Claims, 1 Drawing Figure

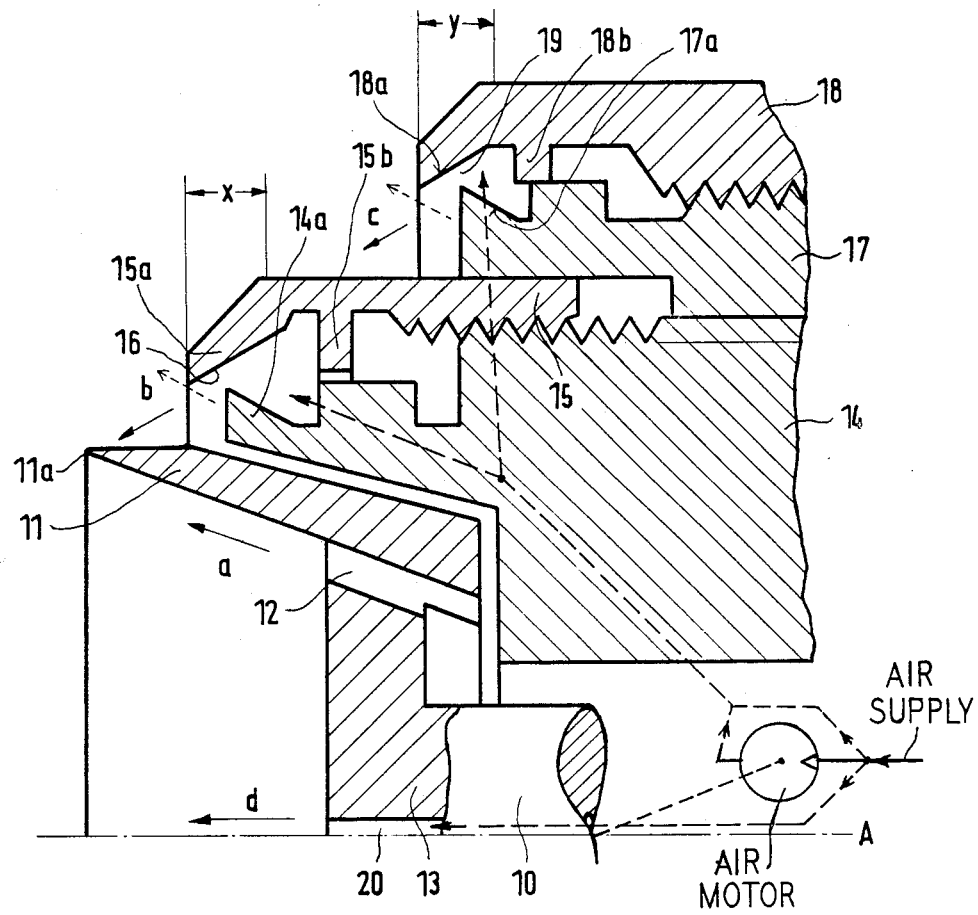
y
19
18b
17a
18a
18
15b
x
14a
c
17
15a
16
b
15
14
11a
11
a
12
AIR
SUPPLY
d
A
20
13
10
AIR
MOTOR

ELECTROSTATIC SPRAYING APPARATUS

BACKGROUND OF THE INVENTION

1. Field of the Invention

The present invention relates to an electrostatic spray apparatus for applying a liquid coating material to a work piece, and more particularly to such apparatus which comprises a rotating, bell-like or disc-like atomizer head, the coating material being applied to its inner surface and being catapulted from its edge, and comprising an annular gap which is coaxial with the atomized head and connected to a compressed air source which ejects a compressed air jacket surrounding the atomized coating material.

2. Description of the Prior Art

Conventionally, the additional use of compressed air is considered as not being required in electrostatic rotary atomizers because the electrostatic field existing between the rotary atomizer and the work piece deflects the paint catapulted from the atomizer by a centrifugal force and atomized to the work piece and transports it to the work piece. The elimination of an additional compressed air flow, for example, in the direction towards the work piece, however, presumes that the centrifugal force imparted to the paint particles is relatively slight, i.e. the atomizer head is driven at a low speed. The latter, however, involves the disadvantage that the paint throughput, i.e. the amount of paint catapulted and sprayed per time unit is small. Higher and higher rotational speeds of the atomizer head have therefore been employed to increase the paint throughput.

In order to prevent a considerable portion of the paint particles from erupting out of the electrical field as a result of the great influence of the centrifugal force, it is known in the art to provide an annular gap which is coaxial with the atomizer head and which is connected to a compressed air source which produces a compressed air jacket surrounding the atomized coating material (paint cloud). It is further known to also employ the compressed air jacket to match the size or, respectively, diameter of the paint cloud to the respective requirements. It has been demonstrated in practice, however, that certain difficulties occur despite the air jacket. Therefore, particularly given very high atomizer head rotational speeds, an air pressure of considerable magnitude must be selected in order to therefore prevent an eruption of paint particles and an undesired increase in the diameter of the paint cloud. Air streams having such high pressure, however, lead to undesired turbulences and lend the paint particles such high kinetic energy that the influence of the electrostatic field (paint encompassing the work piece) is at least partially canceled. It has further turned out that an air jacket emitted by an annular gap is not sufficiently capable of doing justice both to the requirements of adjustability in the size of the paint cloud and the requirements of avoiding an eruption of paint particles, and as low as possible a flight speed of the paint particles in the direction towards the work piece.

SUMMARY OF THE INVENTION

It is therefore the object of the present invention to provide an improved device of the type initially set forth such that the size and diameter of the cloud consisting of the atomized coating material can be set as desired, whereby, despite the occurrence of turbulences, the eruption of some of the paint particles out of the cloud and too high a flight speed of the cloud in the direction towards the work piece are avoided.

According to the present invention, the above object is achieved in an electrostatic spray apparatus for applying a liquid coating material to a work piece, which comprises a rotating bell-like or disc-like atomizer head, the coating material being applied to its inner surface and being catapulted away from its edge, and comprising an annular gap coaxial with the atomizer head and connected to a compressed air source which ejects a compressed air jacket surrounding the atomized coating material, in that a second, outer annular gap is provided coaxial with respect to the first annular gap and has a greater diameter in comparison thereto, and in that the width of at least one of the two gaps is adjustable.

According to the invention, therefore, an additional, outer annular gap is provided. The inner annular gap is particularly to serve the envelopment of the paint cloud in order to be able to adjust its shape or, respectively, diameter as desired. The outer annular jacket supplied by the additional annular gap, on the other hand, has the principle object of compensating the edge turbulences of the paint cloud which arise, in cooperation with the inner air jacket, and to return erupting paint particles into the cloud. Practical test have shown that it is therefore possible to make due with relatively low air pressures even given rotary atomizers which rotate at high speed. Due to the possibility of width adjustment and, under certain conditions, directional adjustment of the two concentric air gaps, it is thereby possible to undertake a very accurate setting of the cloud size, namely within a very broad range which extends from a very tight, nearly jet-like cloud up to a cloud having a considerable diameter.

The directional adjustability of the two air streams thereby opens up the possibility of either directing these directly to the paint cloud or of permitting them first to impact a component portion, for example, the outer face of the atomizer head, this further increasing the scope of adjustments and adaptations.

BRIEF DESCRIPTION OF THE DRAWING

Other objects, features and advantages of the invention, its organization, construction and operation will be best understood from the following detailed description, taken in conjunction with the accompanying drawing, on which there is a single figure which illustrates the spraying end of an electrostatic spray apparatus, in section, whereby only one side extending from the central axis A is illustrated.

DESCRIPTION OF THE PREFERRED EMBODIMENTS

Referring to the drawing, shown in section is a front part of a spray gun in which one half, i.e. the half below the central longitudinal axis A of the gun is omitted. The gun is seen as comprising a rotary drive shaft 10 connected to a rotary atomizer bell 11 having an atomizer edge 11*a* located at the front end thereof. The liquid to be sprayed, referred to below simply as paint, is supplied to the inner surface of the bell 11 via paint channels 12 which are distributed concentrically relative to the axis A through an inner bell member 13. At a slight distance, the bell 11 is coaxially surrounded by an annular member 14 which has a ring 15 threadedly engaging a forward portion thereof. An annular gap 16 is provided between the forward edges of the annular member 14 and the ring 15. An edge 14*a* of the member 14 limits the annular gap and is slewed so as to be divergent with respect to the axis A and the internal edge surface 15*a* which also limits the gap 16 and is, in contrast to the edge 14, slewed convergent with respect to the longitudinal axis A. An inner projection 15*b* of the ring 15 serves as a guide element when screwing the ring 15 relative to the annular member 14. The gap space behind the annular gap orifice 16 is connected to a compressed air feed (not shown). An annular member 17 is carried by the annular member 14 and engages over the ring 15, whereby a ring 18 threadedly engages the outer surface of the annular member 17 in the forward area of the gun. The annular member 17 and the ring 18 form an annular gap, whereby, corresponding to the annular gap 16, a surface 17*a* of the member 17 limits the gap 19 and is angled divergent relative to the axis A and the inner surface 18*a* of the ring 18 limits the gap 19 and is angled convergent relative to the axis A. The ring 18 also exhibits a guide dog 18*b* which projects radially inwardly and functions similarly to the element 15*b*. The gap space behind the gap orifice 19 is likewise connected to a compressed air line (also not illustrated). Of course, the two annular members 14 and 17 can be a single, coherent component part.

As can be seen from the drawing, the plane of the annular gap 19 is set back relative to the plane of the annular gap 16, whereby the plane of the annular gap 16 is set back relative to the plane of the atomizer edge 11*a* of the atomizer bell 11.

The atomizer bell 11 is connected to a high voltage so that the edge 11*a* represents a known, electrostatic atomizer edge.

The device operates as follows. The bell 11 is placed in rotation by the shaft 10, with the consequence that paint supplied via the channels 12 proceeds along the inner wall of the bell 11 (arrow a) to the edge 11*a* as a thin film, being catapulted from the edge 11*a* due to the influence of the centrifugal force and being atomized and conveyed to the work piece (not illustrated) due to the effect of the electrostatic field established between the bell and the work piece. At the same time, compressed air is supplied to the two annular gaps 16 and 19, the compressed air departing the gaps in the directions indicated by the arrows b and c. Given the illustrated position of the rings 15 and 18, the inner air stream b thereby strikes the outer edge of the bell 11 and the air stream c of the outer gap 19 strikes the outer surface of the ring 15. Both air streams are deflected by their respective impact surfaces so that two mutually coaxial, conical air jacket envelopes, expanding in the direction towards the work piece, arise. When, for example, the ring 15 on the annular member 14 is now threaded towards the rear, then the annular gap 16 becomes narrower until, when half the displacement path x has been reached, it is finally completely, or nearly completely, closed. The direction b of the air stream is thereby also changed, in particular, such that the flow direction b comes closer and closer to parallelism with the axis A. When the ring 15 is advanced even further towards the rear, then the annular gap 16 opens again and, at the end of the displacement path x, again finally reaches its full width. The direction of the air stream b is thereby likewise changed, namely, such that the air stream, as viewed toward the work piece, diverges more and more, as indicated by the broken arrow.

The same adjustment as provided the annular gap 16 can also be carried out relative to the annular gap 19, whereby the gap is first closed when the ring 18 is screwed rearwardly and again opens and the direction c of the compressed air stream is modified from greatly convergent to greatly divergent, as indicated by the representative solid and broken arrows. Given divergent ejection directions of the air streams, of course, the same no longer strike the outer edge of the bell, respectively, the outer edge of the ring 15. The air envelope supplied by the inner annular gap 16 sees to the desired shape of the atomizer cloud, while the air envelope supplied by the outer annular gap 19 sees to it that paint particles erupting from the cloud are returned into the cloud. In that both the widths of the annular gaps and, therefore, the strength of the air envelope and the directions of air ejection can be set as desired, in particular, separately for both annular gaps, the possibility derives of dimensioning the atomizer cloud accurately in the manner desired and, in addition, of assuring that essentially no paint particles leave the cloud. Thereby, due to the double air screen, this can be achieved with compressed air under relatively low pressure so that the compressed air does not transmit too high a kinetic energy to the paint particles which disrupts the effect of the electrostatic field. Moreover, the two relatively weak air envelopes lead only to insignificant turbulences in the area outside of the atomization cloud. Should turbulences due to under pressure in the center of the bell occur, this effect can be eliminated by way of an additional, central compressed air line 20 which essentially causes axial emission as indicated by the arrow d.

The invention is subject to numerous modifications. Therefore, for example, it is not necessary in some cases for both air gaps 16 and 19 to be separately adjustable. In this case, the rings 15 and 18 are connected to one another for common movement. It can also suffice in some instances when only the gap widths are adjustable, the directions of the air streams remaining constant in contrast thereto. The mutually opposing, inner angles of the surfaces limiting the gap are then superfluous in such instances. Further, it is also possible to design the rings 15 and 18, here illustrated as screw members, as simple sliding sleeves, given, however, the precondition that care is taken to see to it that the rings do not unintentionally slide by themselves during operation. Finally, it is likewise not always necessary that the catapulting edge 11*a*, the annular gap 16 and the annular gap 19 lie in three different planes or, respectively, that the planes of the annular gaps are located behind the plane of the catapulting edge 11*a*.

Although we have described our invention by reference to particular illustrative embodiments thereof and have referred to various other modifications, many other changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Electrostatic spray apparatus for applying a liquid coating material to a workpiece, comprising:

a rotatable bell-like atomizer head for receiving and centrifugally atomizing liquid coating material and propelling the same as a cloud towards the workpiece;

first means defining a first annular gap coaxial about said atomizer head for connection to a compressed air supply for controlling the outer limits of the cloud; and second means defining a second annular gap coaxial about said first annular gap for connection to a compressed air supply for returning to the cloud those particles of the liquid coating material which erupt out of the cloud, each of said first and second means comprising a first element including a first section limiting the respective air gap, and a second ring element mounted on and coaxially movable with respect to said first element and including a second section limiting the respective air gap.

2. The electrostatic spray apparatus of claim 1, wherein:

said first element and said second ring element include telescopically-engaging surfaces.

3. The electrostatic spray apparatus of claim 1, wherein:

said first element and said second ring element comprise threadedly engaging elements.

4. The electrostatic spray apparatus of claim 1, wherein:

said first elements are integrated as a single component.

5. The electrostatic spray apparatus of claim 1, wherein:

said second, ring shaped elements of said first and second means are connected together and mounted for axial movement with respect to said first elements of said first and second means.

6. The electrostatic spray apparatus of claim 1, wherein:

each of said first sections includes a divergent surface with respect to the longitudinal axis of said atomizer head; and each of said second sections includes a convergent surface with respect to said axis.

7. Electrostatic spray apparatus for applying liquid coating material to a work piece, comprising:

a rotatable bell-shaped atomizer head including an inner surface for receiving liquid coating material and a catapult edge for emitting particles centrifuged therefrom as a cloud towards the work piece;

a first member concentric about said atomizer head including a section defining one side of a first annular gap;

a second member axially movable with respect to said first member and adjustably defining a second side of the first annular gap;

a third member carried on said first member and defining one side of a second annular gap coaxial with the first annular gap;

a fourth member axially movable with respect to said third member and adjustably defining a second side of the second annular gap; and means for connecting the first and second annular gaps to at least one compressed air supply to jacket the cloud with a first containing air jacket to limit the cloud and an outer second air jacket to return erupting particles to the cloud.

8. The electrostatic spray apparatus of claim 7, wherein:

said first and second members include threaded engaging sections for adjustment of the first annular gap.

9. The electrostatic spray apparatus of claim 7, wherein:

said third and fourth members include threaded engaging sections for adjustment of the second annular gap.

* * * * *